US006308847B1

(12) United States Patent
Andersson et al.

(10) Patent No.: US 6,308,847 B1
(45) **Date of Patent: *Oct. 30, 2001**

(54) MEDICAL CONTAINERS

(75) Inventors: Gunnar Andersson, Sollentuna (SE); Des Mulligan, Co Donegal (IE)

(73) Assignee: Fresenius Kabi Aktiebolag, Uppsala (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/859,086

(22) Filed: May 20, 1997

Related U.S. Application Data

(60) Provisional application No. 60/017,940, filed on May 20, 1996.

(51) Int. Cl.[7] ..... B65D 39/00; B65D 53/04

(52) U.S. Cl. ..... 215/247; 215/249; 215/261; 215/DIG. 3

(58) Field of Search ..... 215/247, 248, 215/249, 251, 252, 253, 256, 261, 307, 355, 358, DIG. 3; 604/408, 411, 415; 422/25, 26; 220/256, 257

(56) References Cited

U.S. PATENT DOCUMENTS

| | | | | |
|---|---|---|---|---|
| 4,230,231 | | 10/1980 | Burnett et al. . | |
| 4,297,316 | | 10/1981 | Cunningham . | |
| 4,614,276 | * | 9/1986 | Ihara et al. | 215/364 |
| 4,616,052 | * | 10/1986 | Habibullah | 524/104 |
| 4,616,064 | * | 10/1986 | Zukosky et al. | 525/92 B |
| 4,810,752 | * | 3/1989 | Bayan | 525/98 |
| 4,978,714 | * | 12/1990 | Bayan et al. | 525/69 |
| 5,088,995 | * | 2/1992 | Packard et al. | 215/247 |
| 5,093,423 | * | 3/1992 | Bayan et al. | 525/99 |
| 5,431,280 | * | 7/1995 | Bryant | 206/363 |
| 5,433,330 | * | 7/1995 | Yatsko et al. | 215/247 |
| 5,657,891 | * | 8/1997 | Bilani et al. | 220/256 |

FOREIGN PATENT DOCUMENTS

| | | |
|---|---|---|
| 0 670 709 B1 | 4/1997 | (EP) . |
| 501 925 | 6/1995 | (SE) . |
| WO 95/08317 | 3/1995 | (WO) . |
| WO 95/25177 | 10/1995 | (WO) . |

* cited by examiner

*Primary Examiner*—Allan N. Shoap
*Assistant Examiner*—Niki M. Eloshway

(57) ABSTRACT

A sealed container opening, intended for fluid communication with a container for storing medical fluids, comprising a tubular sleeve-formed part (22, 22A) having a resilient pierceable stopper (24, 24A) inserted in its mouth (21, 21A) and a covering sealing device (10, 10A). The sealed container opening contains the same autoclavable polyolefinic material as the container. All parts of said container opening, exposed to the fluid or fluid handling devices are sterilized in a single process by means of steam transferred to these parts during its autoclavation. Saddle formed port systems attachable to a flexible containers are also disclosed.

11 Claims, 2 Drawing Sheets

MEDICAL CONTAINERS

This application claims the benefit of provisional No. 60/017,940 filed May 20, 1996.

FIELD OF THE INVENTION

The present invention relates to improved openings for medical containers, especially suitable for containers storing parenterally administerable fluids which preferably should be sterilized by steam after being finally assembled filled and scaled.

BACKGROUND OF THE INVENTION

For manufacturers of parenteral fluids who wish to replace the traditional glass containers, it has been a highly demanding problem to find a polymeric material capable of withstanding autoclavation and yet be able to meet the often rigorous requirements set on its oxygen barrier and water vapor barrier capacities. Especially when sensitive fluids for use in parenteral nutrition, such as lipid emulsions containing long chain polyunsaturated fatty acids, amino acid solutions and carbohydrates shall be heat sterilized and stored for a long time, problems with oxygen induced degradation and incompatibility with the polymeric material, might lead to the appearance of potentially hazardous products. A solution to the problem of finding a suitable storage system comprising a flexible container filled with parenteral nutrients to replace glass bottles is demonstrated in the as yet unpublished Swedish patent application 9601348-7.

When manufacturing different types of containers of polymeric materials for storing parenterally administerable fluids, it has been a considerable problem to provide a suitable degree of sterility for all the parts of the container. It would also be highly desirable, for reasons of safety for the patients, for the convenience of hospital personal and for economical reasons to achieve and maintain a suitably high degree of sterility by means of a single steam sterilization process (i.e. autoclavation) which is performed after the container has been finally assembled, filled and scaled.

Flexible containers for storage of parenteral nutrients are conventionally provided with ports for filling and dispensing of the nutrients. Tubular ports may be attached by means of welding when forming side seams, as performed in the International Patent Application WO 95/26177 (Fresenius AG). Another manner of providing a flexible container with ports is disclosed in the above mentioned Swedish patent application 9601348-7, wherein a flexible polymer material is introduced in the form of sheets, to which a saddle formed port system comprising two separate ports is attached. When manufacturing such a container two holes are pressed in the sheet for the tubular ports, whereupon the saddle is welded to the sheet which is folded and welded to a bag shaped container by forming two side seams and a top seam. The container may be filled through the saddle formed port, or preferably by one or more temporary ports in connection to the welded seams before it is sterilized.

Conventional saddle-formed port systems normally comprise an additive port for the introduction to the container, just before administration, of a complementary perishable fluid, such as a solution of vitamins to a stored parenteral nutrient. It will also comprise a dispensing port for establishing a fluid connection between the container and the patient in need of fluid therapy. The ports are generally tube formed and often of a predetermined different size in order to clearly show their identity to the user.

The additive port is often sealed with a stopper made of latex rubber fitted in mouth of the port which can be penetrated by a needle. The dispensing port is typically formed with a membrane of polypropylene which can be pierced with a spike connected to the infusion device. The mouth of such a port is finally sealed before storage by a removable cap or a foil. These ports have a drawback in that the small space between the stopper and the sealing cap or foil will not be reached by sterilizing steam which constitutes a risk for contamination in connection with the penetration. To solve this problem, the saddle-formed port systems have either been pre-sterilized by means of radiation before being assembled to the bags or alternatively a water droplet has been introduced in the small space to provide sterilizing vapor during the heat treatment. Both these solutions are unsatisfying, since they require either an extra sterilization routine by radiation which often might deteriorate the quality of polymeric materials or an extra water droplet adding routine. Whenever using this type of container, handling personnel at hospitals are instructed to, as an extra safety routine, wipe the latex rubber with a disinfectant before piercing it with a needle connected to an infusion tubing.

The same problem is also present with the type of plastic bottle formed containers made with a "blow-fill-seal" method, as described in the Swedish patent application 9303123-5. This type of bottles are sealed by a resilient stopper and a cap at the top of the bottle and finally sealed in the autoclave with a weak seal between the stopper and the inner surface of the container neck. The small space between the stopper and the cap will not be properly sterilized by steam unless a water droplet is introduced in a separate process. An incorrectly sterilized pierceable surface means a risk for contamination, especially when the containers are aimed for storage of several dosages and several collections of fluid will be made by piercing the stopper with a needle.

It would also be highly desirable to be able to recycle also a bag-formed container with an attached saddle-formed port system without a laborious dismembering and collection of different materials in separate processes, as being made possible with the containers, according to the mentioned the Swedish patent application 9303123-5. The frequently used resilient latex stopper of the ports must be individually collected from used bags before they can be recycled. The presence of any latex stoppers will effectively spoil a recycling process of polypropylene based bags. It would also be advantageous to benefit from the advantage of introducing sealing weak weldings with the final heat sterilization, as obtained between the container body or the cap and elastomeric sealing device in the mentioned Swedish patent application 9303123-5.

It would also be desirable to provide a saddle formed port system having ports which fit to high number of spike connections without leakage so they are compatible with a large number of infusion sets existing on the market. Dispensing ports sealed with a polypropylene membrane, in particular will often leak and are not sufficiently resealable after being pierced. On the other hand, latex stoppers in addition ports have a drawback in their tendency to be unintentionally displaced from the mouth of the port. This type of sealing device might also cause problems due to particles torn off when being penetrated

SUMMARY OF THE INVENTION

According to the present invention it is intended to provide pierceable openings for medical containers that can overcome the above mentioned problems both in saddle port systems for bag formed containers and other types of containers.

It is an object of the invention to provide a sealed opening for a medical container that is capable of being correctly sterilized by steam in all parts exposed to the fluid and fluid handling devices.

It is another object of the invention to provide a medical package for parenterally administerable fluids where all parts exposed to the fluids or to fluid transferring devices are correctly sterilized in a single operation after it has been finally assembled and filled.

A specific object of the present invention is to provide a flexible bag-formed container for storage of parenteral fluids having a saddle-formed port system for introducing fluids to and dispensing fluids from the bag that is possible to sterilize in a single operation, and where all surfaces of the sealed opening that will be exposed to the fluid and fluid handling devices are correctly sterilized by steam.

A further specific object of the invention is to provide such a completely sterilizable bag-formed container with a saddle-formed port system that has a cheap environmentally friendly construction that can be recycled in the same process without dismembering its parts before its disposal.

A still further specific object of the invention is to provide the saddle-formed port system of the container with openings that are possible to attach to a high number different connecting spikes.

These objects of the invention will be attained by the subject-matter disclosed herein. The invention as disclosed in the following part will also provide a solution to problems stated above.

The present invention is directed to container openings for fluid communication with a container for storing medical fluids, especially for parenteral administration. The container opening comprises a tubular sleeve-formed part with a resilient and pierceable stopper inserted in its mouth and a sealing device covering the mouth and stopper. The tubular sleeve-formed part, the stopper, and the sealing device contain, at least to a substantial amount, are formed of the same polyolefinic material, so they can be recycled with same process In a recycling plant without being dismembered and separately collected after use. It is a characteristic feature of a sealed container opening according to the present invention that it can be heat sterilized by steam in a single process while all its parts, that will be exposed to, or come in contact with, either with the fluid directly or devices used for handling or transferring the fluid are sterilized by means of direct contact with steam transferred to the parts during the autoclavation.

According to a first embodiment of the invention, the steam is transported to the space between a cap formed sealing device and the stopper, otherwise unavailable for direct steam sterilization. This space is reached with steam from a steam transporting axially directed annular slit, formed between the peripheral surface of the stopper and the inner peripheral surface of the tubular sleeve formed part during the autoclavation of the container. The steam transporting slit appears when the tubular sleeve expands more in a radial direction than the stopper during the autoclavation. According to this embodiment, the cap formed sealing device can be provided with a preformed rupture line so the user can twist off the cap to expose a sterile surface for immediate penetration with a spike or a needle.

According to a second embodiment the inventive container openings are provided with a covering sealing device in the form of peelable foil. This foil can be penetrated by steam during in the autoclave, so the upper pierceable surface beneath the foil and the space between the foil and the stopper is sterilized by direct contact with steam.

It is preferred, according to the invention, that the stopper, besides the polyolefinic material, contains a thermoplastic elastomer. Preferred polyolefinic materials, according to the invention are polypropylene and/or polyethylene.

The present invention is also directed to a container having at least one of the aforedescribed openings comprising a tubular sleeve-formed part closed with a resilient, pierceable stopper and a sealing device, wherein all parts of the container and its orifice essentially consist of the same polyolefin. The container can either be in the form of a flexible bag having at least one of the orifices or in a conventional bottle formed container of a polyolefin based material with a sealed orifice having the features.

DETAILED DESCRIPTION OF THE INVENTION

Figure 1:
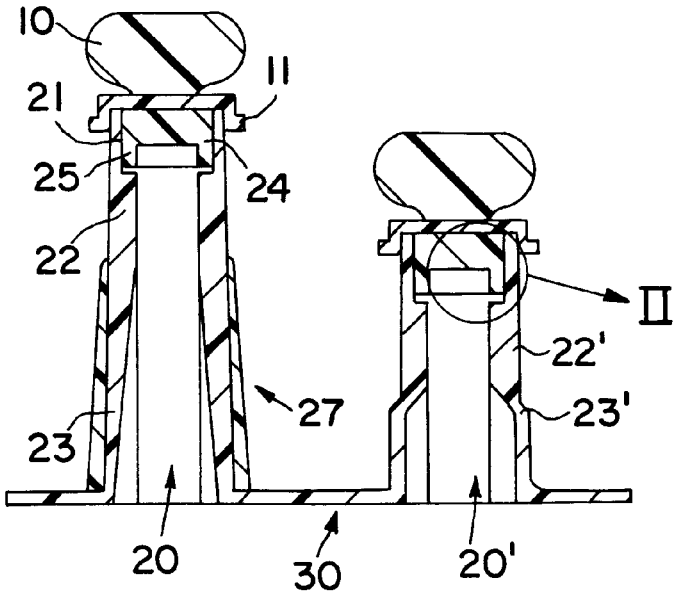
FIG. 1 shows an inventive saddle-formed port systems with two ports having openings according to the present invention.

FIG. 1, shows a side view of an inventive saddle-port system 30 with two openings for fluid communication with a container (not shown) constituted by the ports 20 and 20' that are of somewhat different size for easily identifying the dispensing and additive port, respectively. Both ports have sealed openings according to the present invention and are largely identical and consist of a generally cylindrical, tubular sleeves 22, 22' which preferably have slightly beveled part 23, 23' of a shape designed to fit various fluid transfer devices, such as conventional spike-formed connections to an infusion device. It is particularly preferred to have such a shape that fits spikes according to the conventional ISO-standard.

A cylindrical resilient and pierceable stopper 24 is positioned in the mouth part 21 of the orifices by means of an insert device 25 which rests on an annular shelf 26. The stopper is made of a resilient thermoplastic elastomer and is designed to fit snugly and sealingly in the mouth. It is conceivable within the context of the present invention to find other suitable designs of the insert device and the annular shelf extended around the inner periphery of the tubular sleeves. The ports can be provided with a finger grip portion 27 to give the user a more comfortable stability when inserting devices for fluid transfer into the port. The mouth of the opening is scaled with a cap formed sealing device 10 which is provided with a flange 11 fitted over the edge of the mouth. To obtain a safe sealing against the environment, the contact surface between the mouth and the cap formed sealing device can be welded together by, for example ultrasonic welding. The cap formed sealing device can also be provided with a preformed rupture line (not shown) that preferably is circular and will burst when it is twisted by the user to provide a round aperture, through which a needle or spike can penetrate the stopper and establish fluid communication with the container.

Figure 2:
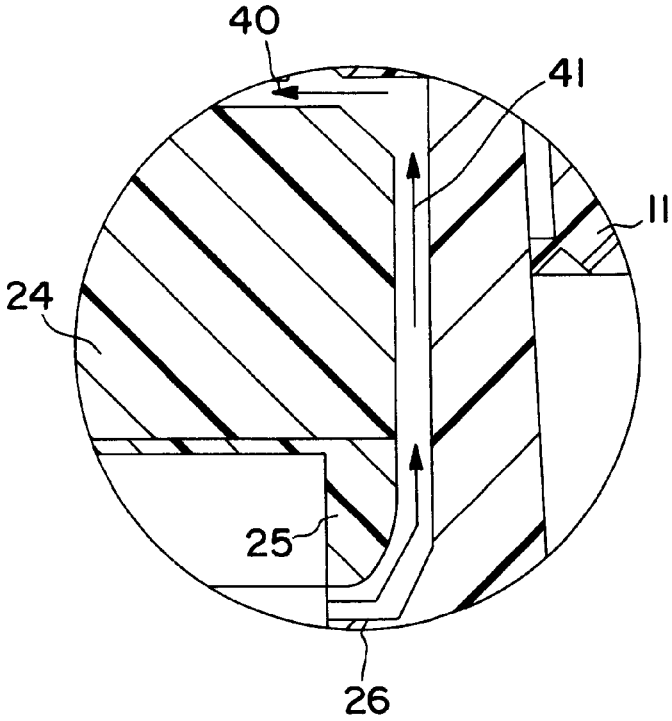
FIG. 2 is an enlarged view of the steam transporting axial slit between the stopper and the tubular sleeve wall in one of the ports according to FIG. 1.

As best demonstrated in FIG. 2, there is a small closed space 40 extended between the cap formed sealing device and the upper face of the stopper which might never be reached by sterilizing steam from the inside of the container during the autoclavation process. As a result, the surface penetrated by a needle or a connecting spike might be contaminated due to an unsatisfying sterilization which in the worst case will waste the fluids of the container and be hazardous for the patient.

This problem is solved with the present invention by the temporary formation of an axially extended annular slit 41 between the peripheral surface of stopper and the inner peripheral wall of the tubular sleeve of the orifice. The slit 41 opens for transportation of steam from the interior of the container to the closed space 40 during the autoclavation of the container. Such an axial slit is formed when the tubular sleeve expands more in a radial direction than the stopper during the heat treatment in the autoclave. When the container subsequently is cooled in the autoclave, the slit closes because of a comparable contraction of the stopper and the sleeve and a weak seal is formed in their contact surface.

The formation of a slit and the subsequent formation of a weak seal in the autoclave requires a careful selection of polymeric materials. To successfully obtain weak seals, it is important that the stopper contains a certain amount of a thermoplastic elastomer, such as a dispersed EPDM-rubber or SEBS (styrene-ethylene-butadien-styrene copolymer), so the stopper can exert a balancing pressure when tubular sleeve expands and contracts during the autoclavation process. A high compatibility between these parts is also required, because molecules must be exchanged in the contact surface of the parts, in order to form a weak seal. Both the stopper and the tubular orifice sleeve, should therefore contain the same polyolefinic material, in order to obtain such a molecular compatibility. This requirement that must also be set on the entire port system for enabling it to be recycled together with the rest of the container. The port system must, consequently, also be compatible with the material of the flexible container, so it can successfully be attached to it by means of welding during the assembly. Moreover, the stopper must have a certain resilience to meet the requirements of obtaining a weak welding, as well as being resealable, so it can be penetrated several times and maintain the integrity of the container. It is also a requirement that the stopper material shall have a certain friction against the connection spike to prevent the spike from being unintentionally displaced from the stopper and to provide a sealing connection with the high number of different types of connecting spikes existing on the market.

A suitable material for the stopper is a polyolefin polymer that which contains a thermoplastic elastomer. The same polyolefin must be present, both in the remaining parts of the port system and in the container. Suitable polyolefin materials are polyethylenes or polypropylene, their mixtures and copolymers of various medical grades. It has been shown in the present invention that it is surprisingly advantageous to have a high amount of polypropylene in the port system compatible with a polypropylene containing material in the containers.

For the stopper it is especially preferred to select materials of polypropylene containing a certain amount of a thermoplastic elastomer like DYNAFLEX® from GLS Corp. comprising polypropylene and SEBS. However other polypropylene based materials having comparable characteristics can be used in the present invention, such as those having dispersed particles of EPDM-rubber in the matrix like SANTOPRENE® from Monsanto. A stopper made of such a material will also solve the problem with particles torn away as a result of its penetration and it has a high resealing capacity after a penetration.

The material of the remaining saddle-formed port system shall preferably be compatible with the material of the infusion bag in order enable a suitable attachment, for example by means of welding. Both materials shall preferably contain the same polyolefinic material so they are capable of being recycled in the process and so a separate collection procedure is avoided. A suitable material for the bag formed infusion container is based on polyolefines, such as polyethylene or polypropylene, their mixture and copolymers. A preferred material is EXCEL® from McGaw Inc., generally described in the European patent 0228919.

EXCEL® has a multilayered structure substantially comprising:

mixture of a polyethylene/polypropylene copolymer (FINA Dypro Z 9450) and KRATON® G1652 from Shell (a styrene/ethylene/butadien/styrene copolymer);

b) a middle, tie layer of pure KRATON® G1652; and c) an outer, release layer of ECDEL® 9965 (or 9566 or 9967) from Eastman Kodak & Co. that is a cycloaliphatic thermoplastic copolyester (a copoly (ester ether), a condensation product of the trans isomer of 1,4-dimethyl-cyclohexanedicarboxylate, of cyclohexanedimethanol and hydroxyterminated polytetramethylene glycol).

When using EXCEL® as the material for the bag formed container, the saddle formed port system suitably contains polypropylene and preferably consists of a mixture of polypropylene and KRATON® that which is weldable to the inner layer of the EXCEL® film. Suitable mixtures are in range of about 80 to 40% polypropylene and 20 to 60% KRATON®. The polypropylene is of homogenous interpenetrating polymer network (IPN) quality, capable of forming weak seals at about 105 to 120° C., preferably at about 117° C. and a permanent welding at about 160° C. However, the skilled person will have no difficulty in finding appropriate compositions of polypropylene and thermoplastic elastomer for the inventive port system and its constituents given the provisions set out above.

Figure 3:
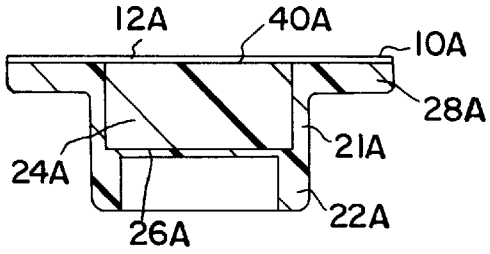
FIG. 3 shows an alternative embodiment of an opening according to the present invention.

An alternative embodiment of a sealed opening to a medical container, according to the invention, is demonstrated in FIG. 3. This opening is suitable in the previously discussed saddle-formed port systems, has a generally cylindrical part 22A with a mouth 21A. A resilient and pierceable stopper 24A is sealingly positioned in the mouth and rests on the annular shelf 26A formed in said sleeve 22A. The stopper 24A is made of a resilient pierceable material, suitably a polyolefin containing a certain amount of a thermoplastic elastomer and preferably DYNAFLEX® or a comparable material as disclosed above. The other parts of the orifice preferably are made of polypropylene with mixtures of KRATON®, as also disclosed above. The opening is sealed before sterilization by a sealing device 10A in the form of a peelable foil 12A that is sealingly fitted over an annular outwardly extended protrusion 28A of the mouth 21A. In order to be able to correctly steam sterilize all parts of the orifice including the connected filled container, steam must the transferred also to the upper surface 40A of the pierceable stopper 24A, which shall be penetrated by a needle or a spike. A transfer of steam therefore must be arranged through the peelable foil in the autoclave, while the foil also must be capable of maintaining sterile conditions and prevent airborne or contact contamination of the surface 40A during the subsequent storage. The material of the peelable foil must therefore be selected among steam permeable, but heat resistant materials that otherwise can form an effective sealing barrier for contaminating agents. Suitable materials are found among spun polyolefins, such as TYVEK® from DuPont and among certain qualities of lacquered papers.

Figure 4A:
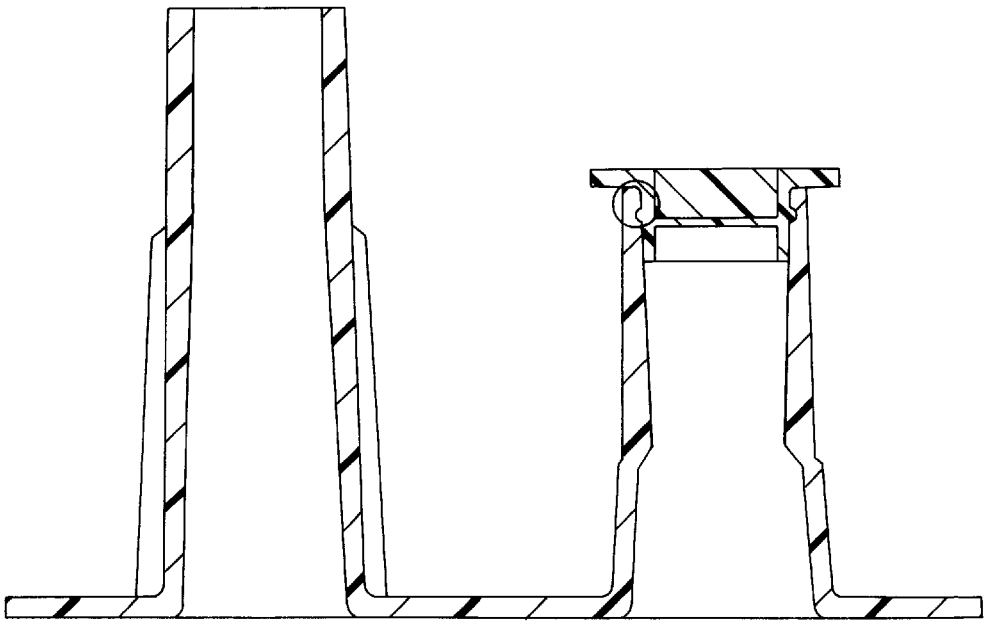
FIG. 4 shows a saddle-formed port system having the alternative opening of FIG. 3 attached.
Figure 4B:
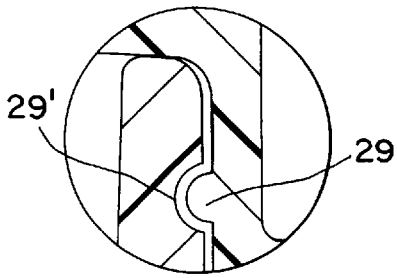

As demonstrated in FIG. 4, this type of container opening is preferably connected to the mouth part of the generally cylindrically formed sleeves of a port of a saddle formed port system. To facilitate the connection to the sleeves, the outer peripheral surface of the cylindrical part 22A can be provided with an annular protrusion 29 that is intended to fit in a corresponding annular recess 29' provided in the inner peripheral surface of the sleeve formed port. These features will also enable the container opening to be safely fixed to the sleeve during handling, to avoid unintentional dismemberment when removing a spike or a needle penetrating the stopper.

The openings are manufactured in a process wherein the DYNAFLEX® is injected into a pre-shaped cylindrical opening by means of a two-color mold injection machine, whereupon the foil is assembled in a separate process.

When using such a container opening for fluid transfer, the foil 12A will be removed by a simple peeling motion to expose the sterile upper pierceable surface 40A of the stopper which can immediately be pierced by a conventional connection spike or a comparable device for establishing fluid connection without risk of contamination.

Besides the advantages stated above, the described sealed container openings and the saddle-formed port systems including them will, for many practical applications, eliminate the use of a secondary, outer pouch wrapped over the bag-formed container during storage for standard solutions and other parenteral solutions. even if certain oxygen sensitive products like amino acids and lipid emulsions will require additional protective measures.

It is also to be understood that the inventive container openings should not be regarded as limited to use with saddle formed port systems connected to flexible bag-formed containers. They are equally useful as parts of a bottle shaped more rigid polymer container containing sensitive medical fluids that require autoclavation before storage.

The examples provided above are intended to illustrate functioning embodiments of the present invention and shall not be regarded as limiting for the scope of invention, as it is presented by the following set of claims.

What is claimed is:

1. An autoclavable container for storage of medical fluids, comprising:

at least one container opening comprising a tubular sleeve interconnected with the container for fluid communication with the container, a resilient pierceable stopper arranged in a mouth of the sleeve, and a seal arranged on the sleeve for sealing the mouth of the sleeve and comprising a peelable foil capable of being penetrated by sterilizing steam to sterilize a space between the foil and the stopper, wherein all elements of the opening exposed to fluid contained in the container or fluid handling devices are sterilized in a single process by steam transferred to all elements of the container opening during autoclavation, wherein the container is recyclable in a single process without dismemberment.

2. The autoclavable container according to claim 1, further comprising:

a saddle port system including the at least one opening, wherein the container comprises a polyolefin containing multilayered material, and wherein the opening comprises the same autoclavable polyolefin containing material as the container.

3. The autoclavable container according to claim 2, wherein the polyolefin is polypropylene.

4. The autoclavable container according to claim 1, wherein the container is bottle-shaped and suitable for repeated collections of the stored fluid, and wherein the container and the opening comprise the same polyolefin.

5. The autoclavable container according to claim 4, wherein the polyolefin is polypropylene.

6. The autoclavable container according to claim 1, wherein the seal comprises a peelable foil capable of being penetrated by sterilizing steam to sterilize a space between the foil and the stopper.

7. A saddle-formed port system attachable to a flexible container of a polymeric material for establishing fluid communication with a medical fluid stored in the container, comprising:

at least one container opening for introducing an additional fluid to be mixed with the medical fluid;

at least one container opening connectable to a fluid transferring device;

wherein each container opening comprises a tubular sleeve interconnected with the container for fluid communication with the container, a resilient pierceable stopper arranged in a mouth of the sleeve, and a seal arranged on the sleeve for sealing the mouth of the sleeve and comprising a peelable foil capable of being penetrated by sterilizing steam to sterilize a space between the foil and the stopper, wherein all elements of the openings exposed to fluid contained in the container or fluid handling devices are sterilized in a single process by steam transferred to all elements of the container opening during autoclavation.

8. The saddle-formed port system according to claim 7, wherein all elements of the openings comprise the same autoclavable polyolefin containing material as a container to which the saddle-formed port system is to be attached.

9. A sealed opening for a container that stores medical fluids, comprising:

a tubular sleeve for interconnection with the container for fluid communication with the container;

a resilient pierceable stopper arranged in a mouth of the sleeve; and a seal comprising a peelable foil arranged on the sleeve for sealing the mouth of the sleeve, the foil being penetrateable by sterilizing steam to sterilize a space between the foil and the stopper;

wherein all elements of the opening comprise the same autoclavable polyolefin containing material as the container and wherein all elements of the sealed opening exposed to fluid contained in the container or fluid handling devices are sterilized in a single process by steam transferred to all elements of the container opening during autoclavation.

10. The sealed opening according to claim 9, wherein the polymeric material comprises at least member selected from the group consisting of polypropylene, polyethylene, mixtures of polypropylene and polyethylene, and copolymers of polypropylene and polyethylene.

11. The sealed opening according to claim 10, wherein the stopper further comprises a thermoplastic elastomer.

* * * * *